United States Patent [19]

Kaneko et al.

[11] 4,273,323

[45] Jun. 16, 1981

[54] SHEET FEEDING APPARATUS FOR COPYING MACHINE, PRINTING MACHINE, ETC.

[75] Inventors: Tamaki Kaneko, Fujisawa; Kenich Mizuma, Yokohama; Tugio Okuzawa, Tokyo, all of Japan

[73] Assignee: Ricoh Co., Ltd., Japan

[21] Appl. No.: 959,597

[22] Filed: Nov. 13, 1978

[30] Foreign Application Priority Data

| | | | |
|---|---|---|---|
| Nov. 24, 1977 | [JP] | Japan | 52-139827 |
| Nov. 24, 1977 | [JP] | Japan | 52-139828 |
| Dec. 7, 1977 | [JP] | Japan | 52-146134 |
| Dec. 8, 1977 | [JP] | Japan | 52-146627 |
| Dec. 12, 1977 | [JP] | Japan | 52-148108 |
| Dec. 12, 1977 | [JP] | Japan | 52-148109 |
| Dec. 14, 1977 | [JP] | Japan | 52-149343 |

[51] Int. Cl.[3] ..... B65H 1/14; B65H 1/26

[52] U.S. Cl. ..... 271/157; 271/126; 271/153; 271/155; 271/164

[58] Field of Search ..... 271/164, 162, 157, 152, 271/153, 154, 155, 156, 126, 127, 30 R, 31, 128, 130, 22, 24, 25; 414/118, 119

[56] References Cited

U.S. PATENT DOCUMENTS

| | | | |
|---|---|---|---|
| 3,378,255 | 4/1968 | Draugelis et al. | 271/154 |
| 3,599,966 | 8/1971 | Delvecchio et al. | 271/162 X |
| 3,843,115 | 10/1974 | DiFulvio et al. | 271/164 X |
| 4,153,242 | 5/1979 | Mizuma | 271/164 X |

OTHER PUBLICATIONS

Campbell et al., *IBM Technical Disclosure Bulletin*, vol. 17, No. 3, Aug. 1974, pp. 670–671.

Hunt et al., *IBM Technical Disclosure Bulletin*, vol. 17, No. 6, Nov. 1974, p. 1549.

*Primary Examiner*—Bruce H. Stoner, Jr.

*Attorney, Agent, or Firm*—McGlew and Tuttle

[57] ABSTRACT

A sheet feeding apparatus for a copying machine, printing machine, etc. having a sheet feeding tray for supporting sheets thereon, which is adapted to be moved out of the machine for replenishing or replacing the sheets and then inserted into the machine and moved vertically within the machine to a sheet feeding position. The sheet feeding tray is mounted in a sheet feeding frame capable of moving into and out of the machine and can be moved vertically in the sheet feeding frame when this frame has reached its sheet feeding position, a common drive motor being provided for moving the sheet feeding frame into and out of the machine and vertically moving the sheet feeding tray within the sheet feeding frame.

6 Claims, 21 Drawing Figures

SHEET FEEDING APPARATUS FOR COPYING MACHINE, PRINTING MACHINE, ETC.

BACKGROUND OF THE INVENTION

1. Field of the Invention

This invention relates to a sheet feeding apparatus for a copying machine, printing machine, etc. which is provided with a sheet feeding tray for supporting sheets thereon capable of moving into and out of a main body of the machine and also in a vertical direction within the main body of the machine.

2. Description of the Prior Art

A sheet feeding tray of a sheet feeding apparatus for supporting sheets thereon is often moved out of a main body of a machine for replenishing the sheets or replacing the sheets by another set of sheets and then inserted into the machine. Upon reaching a predetermined position in the main body of the machine, the sheet feeding tray is lifted until the uppermost sheet of a stack of the sheets thereon comes into contact with a sheet feeding roller for performing a sheet feeding operation. The rotation of the sheet feeding roller feeds only the uppermost sheet to the destination through a pair of separation rollers. It has hitherto been customary to manually move the sheet feeding tray into and out of the main body of the machine, and to vertically move the sheet feeding tray by power within the main body of the machine. The result achieved by a manual operation of moving the sheet feeding tray into and out of the main body of the machine varies from operator to operator. Even if copy sheets are piled correctly in a stack on the sheet feeding tray, the stack of copy sheets will collapse when the sheet feeding tray is moved into the main body at an excessively high speed. When the sheet feeding tray is forcibly moved into the main body, there is a danger that trouble will occur in the machine.

In order that only the uppermost sheet is fed at one time from a stack of copy sheets on the sheet feeding tray, it is important that the uppermost sheet be maintained in a correct position at all times. To this end, a reduction in the number of copy sheets should be detected as soon as possible so as to raise the sheet feeding tray to correct the position of the uppermost sheet. In correcting the position of the uppermost sheet, the movement of the sheet feeding tray should not be effected abruptly to eliminate the influences of inertia and other factors. Stated differently, the sheet feeding tray should be moved quietly and slowly. On the other hand, in moving the sheet feeding tray into and out of the main body of the machine, problems may be raised with regard to the inertia which will be produced when a stack of sheets is suddenly stopped and with regard to the danger which will be experienced when the sheet feeding tray suddenly moves out of the main body of the machine. However, the movement of the sheet feeding tray into and out of the main body of the machine should be carried out as quickly as possible so long as these problems are not raised.

SUMMARY OF THE INVENTION

Accordingly, this invention has as its object the provision of a sheet feeding apparatus for a copying machine, printing machine, etc. which obviates the aforementioned disadvantages of the prior art and proposes to carry out by power not only the vertical movement of the sheet feeding tray within the main body of the machine but also the movement of the sheet feeding tray into and out of the main body of the machine.

Also, this invention proposes to carry out the vertical movement of the sheet feeding tray within the main body of the machine at a lower speed than the movement of the sheet feeding tray into and out of the main body of the machine.

Additional and other objects, features and advantages of the invention will become apparent from the description set forth hereinafter when considered in conjunction with the accompanying drawings showing application of the invention in an electrophotographic copying machine, in which.

Figure 1:
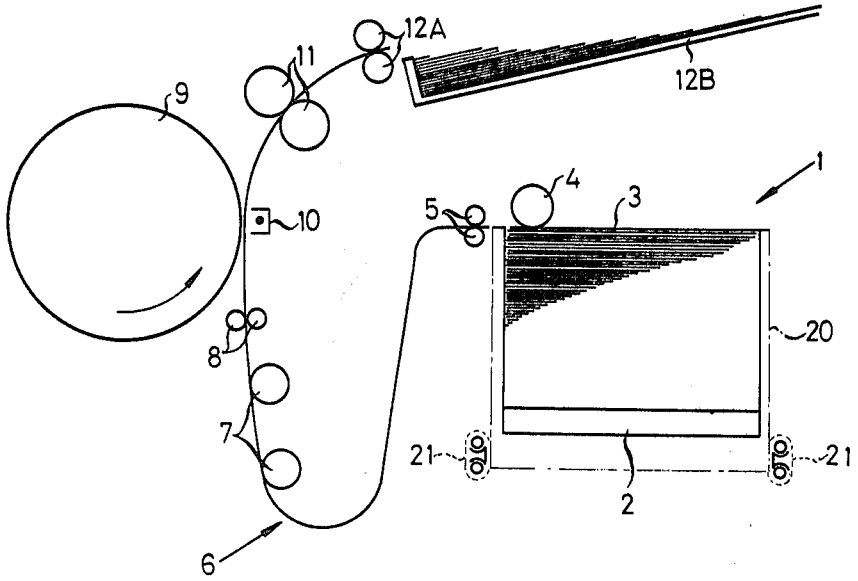
FIG. 1 is a copying machine provided with a sheet feeding apparatus according to the invention.

Referring to FIG. 1, a sheet feeding apparatus 1 includes a sheet feeding tray 2 having a stack of copy sheets 3 piled thereon, and a sheet feeding roller 4 in contact with the uppermost sheet of the stack of copy sheets 3 for feeding the same to the destination. The sheet fed by the sheet feeding roller 4 passes a pair of separation rollers 5 and reaches a buffer section 6 in which a curved guide plate, not shown, obliquely facing rollers 7 and a pair of register rollers 8 are mounted. Guided by the register rollers 8, the sheet reaches a transfer-printing position in synchronism with the movement of a toner image formed on a photosensitive drum 9. In the transfer-printing position, the toner image on the photosensitive drum 9 is transferred to the sheet under the action of a corona discharger 10. Then the sheet passes a pair of fixing rollers 11 and is ejected by a pair of ejecting rollers 12A onto a sheet ejecting tray 12B. Although not shown, a charging device, an exposing device and a developing device are mounted in an usual manner around the photosensitive drum 9.

The sheet feeding tray 2 is movable, as subsequently to be described, in a vertical direction and also perpendicularly to the plane of FIG. 1 in the illustrated embodiment.

Figure 2:
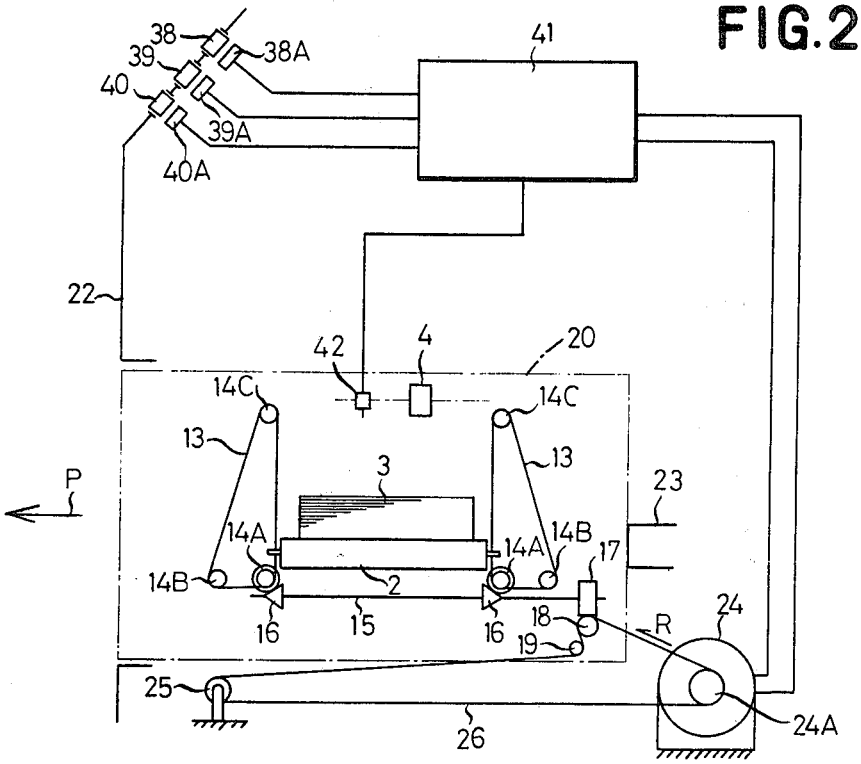
FIG. 2 is a view of the sheet feeding apparatus in which the sheet feeding frame is in a sheet feeding position and the sheet feeding tray is in its lowermost position.

Referring to FIG. 2, the sheet feeding tray 2 is secured on either side thereof to an endless belt 13 trained over pulleys 14A, 14B and 14C. Each pulley 14A has attached thereto a bevel gear which is maintained in meshing engagement with another bevel gear 16 supported by a drive shaft 15. Thus the rotation of the drive shaft 15 causes the endless belts 13 to cooperate with each other to move the sheet feeding tray 2 in a vertical direction. Secured to one end of the drive shaft 15 is a worm gear 17 which is in meshing engagement with a worm attached to a belt pulley 18. 19 designates a tensioning pulley.

The aforementioned various elements of the sheet feeding apparatus are fitted to a sheet feeding frame 20 which can be moved relative to a main body 22 of the machine by a sliding device 21 schematically shown in FIG. 1. 23 designates a stopper for positioning the sheet feeding frame 20 within the main body 20.

The main body 22 has a reversible drive motor 24 having a pulley 24A fixed to an output shaft thereof. A drive belt 26 is trained over the pulley 24A, the pulley 18 of the sheet feeding frame 20, the tensioning pulley 19 of the frame 20 and a pulley 25 secured to the main body 22.

A printing button 38, an out-switch button 39 for rotating the motor 24 in a direction in which the sheet feeding frame 20 moves out of the main body 20 and an in-switch button 40 for rotating the motor 24 in a direction in which the sheet feeding frame 20 moves into the main body 20 are arranged on a control panel in the front of the machine. The switch buttons 38, 39 and 40 have attached thereto switches 38A, 39A and 40A, respectively, which are connected to a control circuit 41 which in turn is connected to the drive motor 24. Thus, depression of the out-switch button 39 causes the drive motor 24 to rotate in a direction for moving the drive belt 26 in an R direction, and depression of the in-switch button 40 causes the drive motor 24 to rotate in a direction for moving the drive belt 26 in a direction (See FIG. 6). 42 designates a sheet detecting switch connected to the control circuit 41.

The provision of the switch means for controlling the movement of the sheet feeding frame 20 into and out of the main body 22 of the machine enables the operation of the sheet feeding frame 20 to be carried out as intended by the operator of the machine. This eliminates the danger and inconvenience which would otherwise be caused by the abrupt movement of the sheet feeding frame into and out of the main body of the machine.

Figure 3:
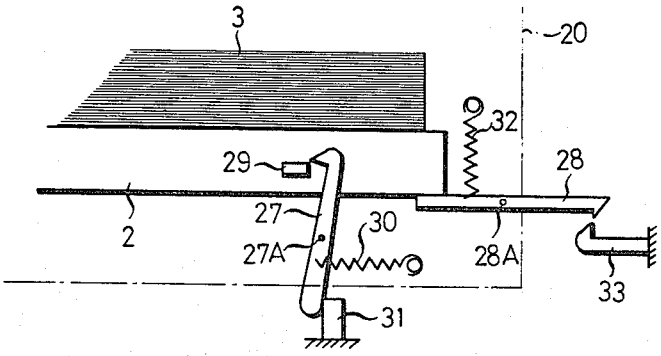
FIG. 3 is a view of locking means for the sheet feeding frame and the sheet feeding tray.

Referring to FIG. 3, the sheet feeding frame 20 has two hook levers 27 and 28 pivotally supported at 27A and 28A respectively. The hook lever 27, which is normally urged by the biasing force of a tension spring 30 to rotate counterclockwise about the pivot 27A, is for detecting the lowermost position of the sheet feeding tray 2 and engages a stopper 29 secured to the sheet feeding tray 2 for preventing the upward movement of the sheet feeding tray 2. 31 designates a sheet feeding tray release pin attached to the main body 22. The hook lever 28, which is normally urged by the biasing force of a spring 32 to rotate clockwise about the pivot 28A, is for detecting the sheet feeding position of the sheet feeding frame 20. The hook lever 28 is moved downwardly at its left end portion by the sheet feeding tray 2 when the latter is in its lowermost position, so as to thereby release a hook of the hook lever 28 from engagement with a stopper 33 attached to the main body 22.

Figure 4:
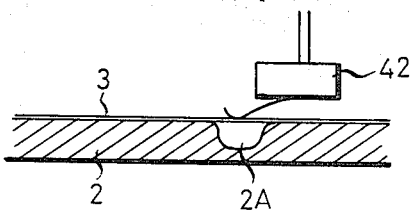
FIGS. 4 and 5 are views showing the manner of operation of the sheet detecting switch.

The sheet detecting switch 42 detects the presence of sheets 3 on the sheet feeding tray 2 as shown in FIG. 4, even if there is only one sheet. When there is no sheet 3 on the sheet feeding tray 2, an actuator of the sheet detecting switch 42 drops into a recess 2*a* formed in the tray 2 in a position corresponding to the position thereof and produces a signal indicating that there is no sheet on the sheet feeding tray 2.

The sheet feeding apparatus constructed as aforementioned operates as follows. When in a position shown in FIG. 2, the sheet feeding frame 20 has moved furthest into the main body 22 and is in a sheet feeding position in which the frame 20 abuts at its right side against the stopper 23. At this time, the sheet feeding tray 2 is in its lowermost position. When the sheet feeding frame 20 is in this position, the hook lever 27 abuts at its lower end against the release pin 31 and the hook lever 27 rotates clockwise about the pivot 27A against the biasing force of the tension spring 30, so that its hook is released from engagement with the stopper or catch 29. The sheet feeding tray 2 pushes the left end portion of the hook lever 28 downwardly, so that the hook of the latter is also released from engagement with the stopper or catch 33. If the sheets 3 on the sheet feeding tray 2 are to be replenished or replaced by another set of sheets, the out-switch button 39 is depressed when the sheet feeding frame 20 is in this position. This causes the motor 24 to rotate in the reverse direction, thereby moving the drive belt 26 in the R direction. Since the sheet feeding tray 2 is in its lowermost position at this time, the tray 2 is unable to move downwardly, so that the drive shaft 15 and belt pulley 18 do not rotate. As as result, the belt pulley 18 and tensioning pulley 19 are moved in the same direction as the movement of the drive belt 26, and the sheet feeding frame 20 moves in a P direction as indicated by an arrow out of the main body 22. The speed at which the sheet feeding frame 20 moves out of the main body 22 is the same as the speed at which the drive belt 26 moves. This speed is relatively high and consequently the time required for the outwardly movement of the sheet feeding frame 20 is short. Upon reaching a predetermined position, the sheet feeding frame 20 actuates a switch, not shown, thereby stopping the rotation of the motor 24. The sheet feeding frame 20 stops in a position shown in FIG. 6.

As the sheet feeding frame 20 begins to move from its position shown in FIG. 2 in the P direction, the lower end of the hook lever 27 is released from engagement with the release pin 31 and the hook of the hook lever 27 is brought into engagement with the stopper 29 by the biasing force of the spring 30, thereby preventing the upward movement of the sheet feeding tray 2 until the sheet feeding frame 20 returns to its position shown in FIG. 2.

Figure 6:
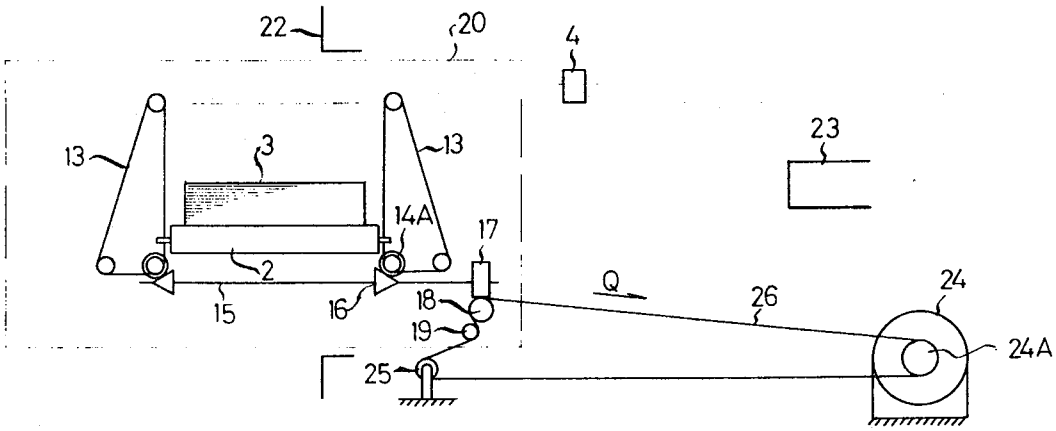
FIG. 6 is a view of the sheet feeding frame which is moved out of the main body of the machine.

Replenishments or replacements of the sheets on the sheet feeding tray 2 are effected while the tray 2 is disposed in the position shown in FIG. 6. Thereafter the in-switch button 40 is depressed to rotate the drive motor 24 in the normal direction. Since the sheet feeding tray 2 is prevented from moving upwardly as aforesaid, the drive shaft 15 is unable to rotate, so that the movement of the drive belt 26 in the Q direction causes the belt pulley 18 and tensioning pulley, and hence the sheet feeding frame 20, to move together with the drive belt 26. Thus the sheet feeding frame 20 moves into the main body 22, at a relatively high speed, to its position shown in FIG. 2. At this time, the lower end of the hook lever 27 abuts against the release pin 31, thereby releasing the hook of the hook lever 27 from engagement with the stopper 29 and bringing the sheet feeding tray 2 to a condition in which it is capable of moving upwardly. Further rotation of the drive motor 24 results in the sheet feeding frame 20 abutting against the stopper 23 and becoming stationary. Therefore, the movement of the drive belt 26 in the Q direction is transmitted through the belt pulley 18, the worm attached to the pulley 18, worm wheel 17, drive shaft 15, bevel gear 16, the bevel gears attached to the pulleys 14A and pulleys 14A to the endless belts 13. The movement of the endless belts 13 moves the sheet feeding tray 2 upwardly. When this is the case, the speed reducing action performed by the worm attached to the belt pulley 18 and the worm gear 17 in cooperation with each other has the effect of reducing the speed of movement of the endless belts 13 to a level below the speed of movement of the drive belt 26. Thus the upward movement of the sheet feeding tray 2 takes place at a lower speed than the movement of the sheet feeding frame 20 into and out of the main body 22.

Figure 7:
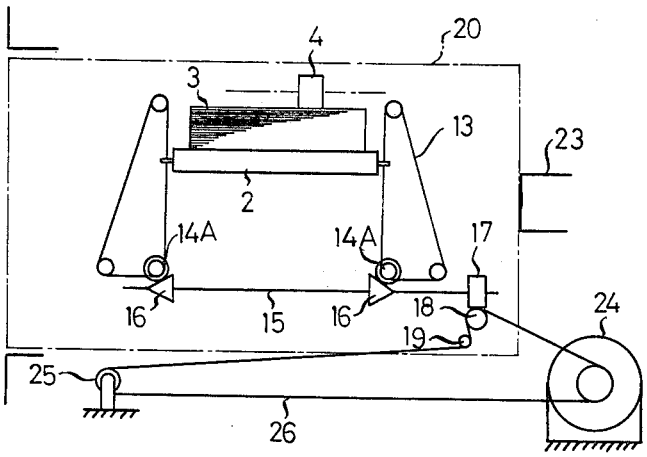
FIG. 7 is a view of the sheet feeding tray in a sheet feeding position.

Upon the uppermost sheet of the stack of sheets on the sheet feeding tray 2 reaching the sheet feeding position in which the uppermost sheet comes into contact with the sheet feeding roller 4 as shown in FIG. 7, the drive motor 24 stops rotating. Detection of the arrival of the uppermost sheet at the sheet feeding position may be effected by any of the known techniques, such as by optical detecting means or by using a switch 72 shown in FIG. 19 for detecting the upward movement of the sheet feeding roller 4. Since the upward movement of the sheet feeding tray 2 takes place at a low speed as aforementioned, the detection of the arrival of the tray 2 at the sheet feeding position ensures that the tray 2 stops in a correct position. Advantageously, the speed of the upward movement of the sheet feeding tray 2 is about 2 cm/sec and the speed of movement of the sheet feeding frame 20 into and out of the main body 22 is 10 to 20 cm/sec.

Feeding of the sheets 3 is effected while the sheet feeding tray 2 is in its position shown in FIG. 7. The downward shifting of the position of the uppermost sheet is detected by the uppermost sheet position detecting means and the drive motor 24 is rotated again to move the sheet feeding tray 2 upwardly. The upward movement of the tray 2 takes place at a low speed at this time too, so that positive and accurate positioning of the sheet feeding tray 2 can be effected.

Figure 5:
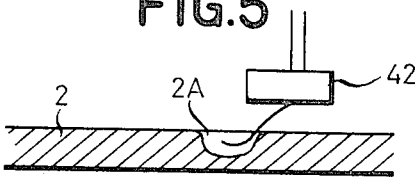

When the sheets on the sheet feeding tray 2 are exhausted, the actuator of the sheet detecting switch 42 described by referring to FIGS. 4 and 5 drops into the recess 2A in the tray 2, and the switch 42 produces a "sheetless" signal which is supplied to the control circuit 41 which in turn rotates the drive motor 24 in the reverse direction to move the sheet feeding tray 2 downwardly. Thus the sheet feeding tray 2 moves to its lowermost position in which it abuts against the left end portion of the hook lever 28 and moves the latter in pivotal motion counterclockwise about the pivot 28A against the biasing force of the spring 32, thereby releasing its hook from engagement with the stopper 33. Thus, the sheet feeding frame 20 is ready for movement out of the main body 22 and stands by in this position. If the out-switch button 39 is depressed at this time, the sheet feeding frame 20 moves out of the main body 22 together with the sheet feeding tray 2, as aforementioned.

If the need arises for replacing the stack of copy sheets on the sheet feeding tray 2 by another stack of sheets of different type, while the sheets are being fed, one has only to depress the out-switch button 39. This rotates the drive motor 24 in the reverse direction and moves the sheet feeding tray 2 downwardly. Upon the sheet feeding tray 2 reaching its lowermost position, the movement of the endless belts 13 is interrupted and the worm gear 17 and the belt pulley 18 having the worm in meshing engagement with the worm gear 17 are unable to rotate, so that the sheet feeding frame 20 having the tray 2 moves out of the main body 22 in conjunction with the movement of the drive belt 26.

The invention thus uses actuating means in the form of the interconnection between the first conveyor 13, 14A, 15 and the second conveyor 26, 25, 19, and the holding hooks 27, 29, to cause the tray 2 to move as desired.

In the movement described hereinabove, a chain, wire and the like may be used in place of the belts 13 and 26 which can be termed, conveying members.

Figure 8:
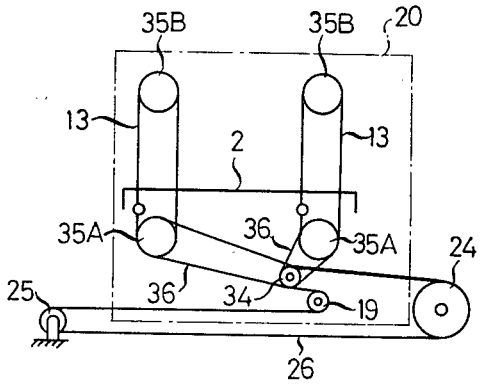
FIG. 8 is a view of a modification of the mechanism for vertically moving the sheet feeding tray.

FIG. 8 shows another embodiment of the invention in which a pulley 34 rotatably attached to the sheet feeding frame 20 is in the form of a triple pulley, and the drive belt 26 and two drive belts 36 trained over pulleys 35A for moving the sheet feeding tray 2 upwardly are trained over the triple pulley 34. The operation of this embodiment is similar to the embodiment shown in FIGS. 2 to 5 except that the speed reduction of the sheet feeding tray 2 is not effected.

Figure 9:
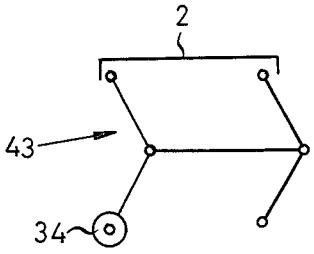
FIG. 9 is a view of another modification of the mechanism for vertically moving the sheet feeding tray.

FIG. 9 shows another embodiment in which a horizontally moving linkage 43 is used for moving the sheet feeding tray 2 vertically. The pulley 34 shown in FIG. 8 may be used in driving the linkage 43.

Figure 10:
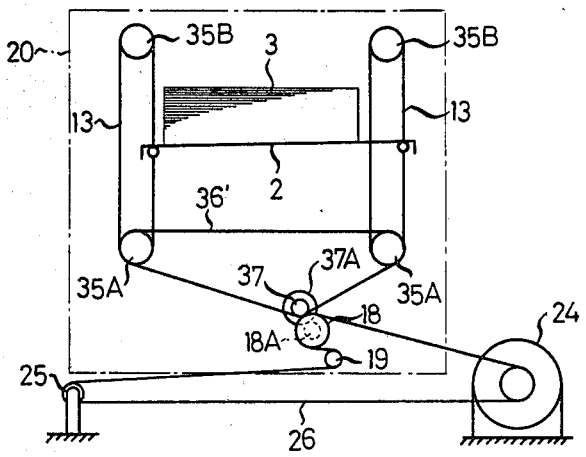
FIG. 10 is a view of the sheet feeding apparatus having speed reducing means operative to vary the speed between the horizontal movement of the sheet feeding frame and the vertical movement of the sheet feeding tray.

Referring to FIG. 10, the sheet feeding tray 2 is supported by the belts 13 each trained over the pulleys 35A and 35B. A common belt 36' is trained over the pulleys 35A. The belt 36' is trained over a pulley 37 rotatably attached to the sheet feeding frame 20 and having attached thereto a gear 37A which is in meshing engagement with a pinion 18A attached to the belt pulley 18. Thus the gear train 18A and 37A has the effect of reducing the speed of movement of the belt 36', with the result that the speed of vertical movement of the sheet feeding tray 2 is reduced below the speed of movement of the sheet feeding frame 20 into and out of the main body 22.

Figure 11:
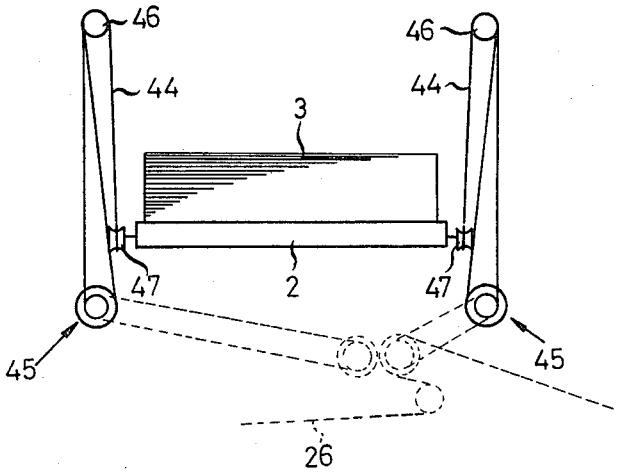
FIGS. 11 and 12 show a modification of the speed reducing means shown in FIG. 10.
Figure 12:
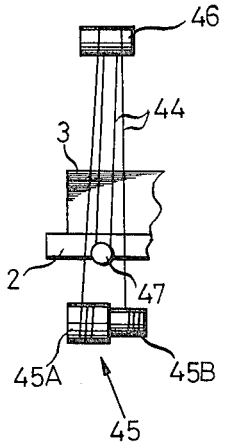

FIGS. 11 and 12 show still another embodiment in which the sheet feeding tray 2 is supported by wires 44 of pulley means mounted on both sides of the tray 2. In each pulley means, the wire 44 which is secured at one end thereof to a major diameter pulley 45A of a double pulley 45 is wound in a plurality of windings on the major diameter pulley 45A, passed from the major diameter pulley 45A to a pulley 46 located in a higher position to be trained thereover, then passed downwardly to a pulley 47 secured to the sheet feeding tray 2 to be trained thereover, thereafter passed over the upper pulley 46 again and finally trained over a minor diameter pulley 45B of the double pulley 45. By this arrangement, the sheet feeding tray 2 supported through the pulleys 47 by the wires 44 at their turning points can have the speed of its movement reduced when it is vertically moved by the pulley means. The double pulleys 45 are driven through a suitable transmission means from the drive belt 26.

Figure 14:
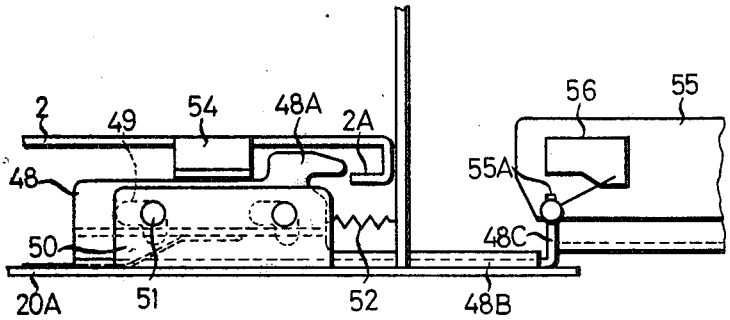
FIGS. 14 and 15 are views showing the manner of operation of the locking means.
Figure 15:
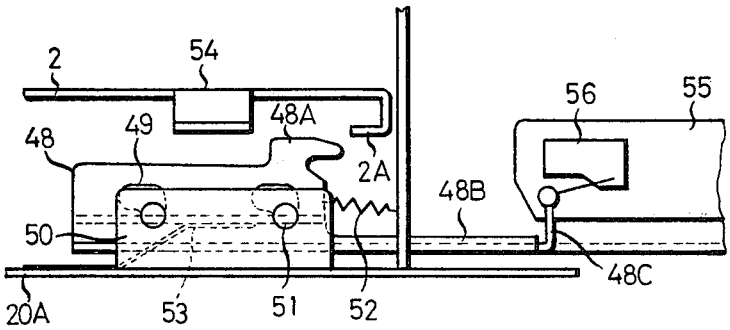

In the sheet feeding apparatus described herein, there is a danger that the sheet feeding tray 2, the sheets 3 supported on the tray 2 or the main body 22 of the machine will be either damaged or destroyed if an attempt is inadvertently made to move the sheet feeding tray 2 upwardly when the sheet feeding frame 20 is disposed in other positions than its regular sheet feeding position, or to move the sheet feeding frame 20 into or out of the main body 22 with the sheet feeding tray 2 being disposed in its upper position. To prevent this accident, the sheet feeding apparatus is provided with locking means shown in FIG. 3. A modification of the locking means shown in FIG. 3 is shown in FIGS. 13, 14 and 15.

Figure 13:
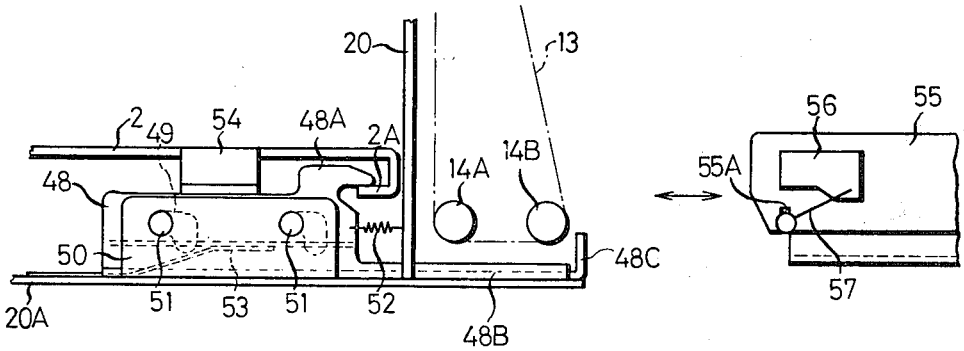
FIG. 13 is a view of a modification of the locking means for the sheet feeding frame and the sheet feeding tray.

Referring to FIG. 13, a stopper plate 48 is mounted in the sheet feeding frame 20 between its bottom plate 20A and the sheet feeding tray 2 for both vertical movement and horizontal movement in the direction of movement of the sheet feeding frame 20. The stopper plate 48 is formed with two L-shaped grooves 49 located in spaced-apart relation and receiving therein pins 51, respectively, which are attached to a stopper bracket 50 secured to the bottom plate 20A of the sheet feeding frame 20 and spaced apart from each other the same distance as the L-shaped grooves 49. The stopper plate 48 is connected to a tension spring 52 which urges the plate 48 to move rightwardly in the figures, and is disposed under the action of a plate spring 53 which urges the plate 48 to move upwardly in the figures. The stopper plate 48 is formed therein with a sheet feeding tray lifting preventing portion 48A adapted to engage a downwardly bent portion 2A of the sheet feeding tray 2, and an extension 48B which extends in the direction of movement of the sheet feeding frame 20 and has a rise portion 48C at its end. 54 designates an abutting member secured to the underside of the sheet feeding tray 2.

The main body 22 has a fixed stopper 55 attached thereto and formed therein with a cutout 55A in which the rise portion 48C of the stopper plate 48 is adapted to engage. Disposed in the cutout 55A is an actuator 57 of a temporary stop switch 56 mounted on the fixed stopper 55.

FIG. 13 shows the sheet feeding frame 20 in other position than the sheet feeding position. At this time, the sheet feeding tray lifting preventing portion 48A of the stopper plate 48 is in engagement with the downwardly bent portion 2A of the sheet feeding tray 2 under the action of the spring 52, thereby preventing the upward movement of the sheet feeding tray 2. The pins 51 attached to the stopper bracket 50 are each disposed on the left end of the horizontal portion of one of the L-shaped grooves 49 in the stopper plate 48.

Upon the sheet feeding frame 20 reaching the sheet feeding position as shown in FIG. 14, the rise portion 48C of the stopper plate 48 abuts against the fixed stopper 55 and the stopper plate 48 is pushed leftwardly in the figure against the biasing force of the spring 52, thereby releasing the sheet feeding tray lifting preventing portion 48A from engagement with the downwardly bent portion 2A of the sheet feeding tray 2. Thus the sheet feeding tray 2 is ready for upward movement. At this time, the pins 51 are each disposed on the right end of one of the grooves 49 and capable of moving downwardly the vertical portion of the respective groove 49. If the sheet feeding tray 2 moves upwardly, then the abutting member 54 thereof is released from contact with the stopper plate 48, thereby permitting the stopper plate 48 to move upwardly as shown in FIG. 15 by virtue of the biasing force of the spring 53. At this time, the pins 51 attached to the stopper bracket 50 are each in contact with the lower end of the vertical portion of one of the L-shaped grooves 49, and the rise portion 48C of the stopper plate 48 is brought into engagement in the cutout 55A formed in the fixed stopper 55, thereby preventing the movement of the sheet feeding frame 20 out of the main body 22. The riser portion 48C actuated the actuator 57 of the temporary stop switch 56.

By the aforementioned arrangement, the sheet feeding frame 20 can move into and out of the main body of the machine only when the sheet feeding tray 2 is disposed in its lowermost position, and the sheet feeding tray 2 can move in the vertical direction only when the sheet feeding frame 20 is disposed in the sheet feeding position in the main body of the machine. Thus, the accident of the collision of the sheet feeding tray 2 against the main body 22 of the machine which would otherwise occur when the sheet feeding tray 2 is moved upwardly while the sheet feeding frame 20 is disposed in other positions than the sheet feeding position or when the sheet feeding frame 20 is moved into or out of the main body 22 while the sheet feeding tray 2 is in its uppermost position, can be positively prevented.

In the sheet feeding apparatus constructed as aforementioned, when two sheets are inadvertently fed by the sheet feeding roller 4, only the uppermost sheet is fed by the separation rollers 5 and the second sheet is stopped by the separation rollers 5 to remain in a position in which its leading edge is disposed in the position of the separation rollers 5. If an attempt is made at this time to move the sheet feeding frame 20 out of the main body to replace or replenish the sheets on the tray 2, the second sheet will also move together with the sheet feeding tray 2. The second sheet, if bitten by the separation rollers 5, would be destroyed and the second sheet or its fragments would remain around the separation rollers 5 and cause some trouble in later operations. To prevent this underable condition, the sheet feeding apparatus described above is provided with means to attain this end which will be presently to be described.

Figure 16:
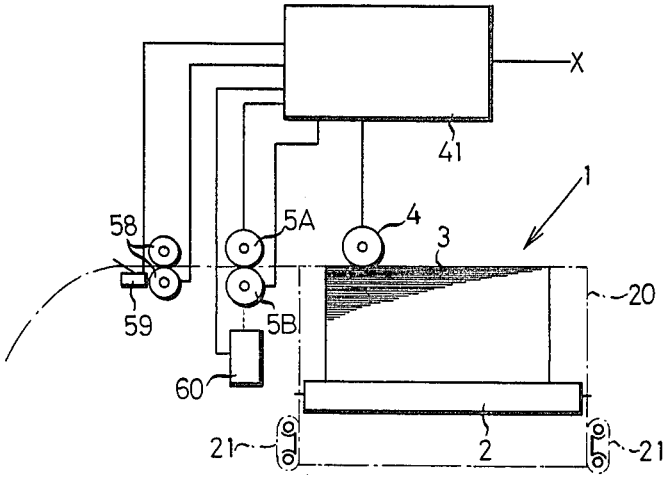
FIG. 16 is a view in explanation of the sheet feeding apparatus provided with means for moving the pair of separation rollers away from each other.

In FIG. 16, the uppermost sheet fed by the sheet feeding roller 4 is supplied by way of the separation rollers 5A and 5B to a pair of positioning rollers 58 from which it is fed to the copying station. 59 is a sensor, and 60 a solenoid for moving the separation rollers 5A and 5B into and out of contact with each other as subsequently to be described.

Figure 17:
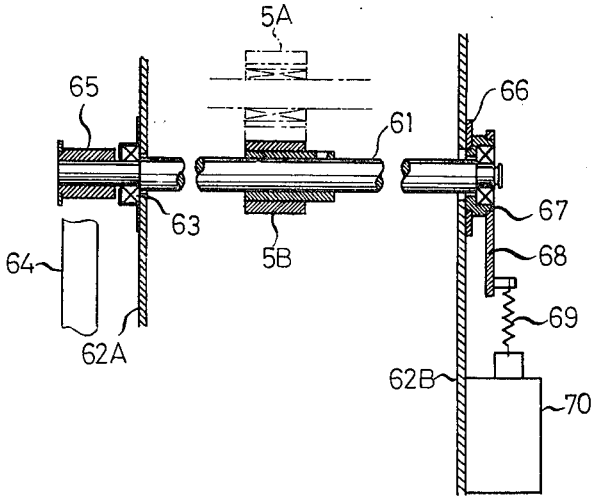
FIG. 17 is a detailed view of the means for moving the separation rollers away from each other.
Figure 18:
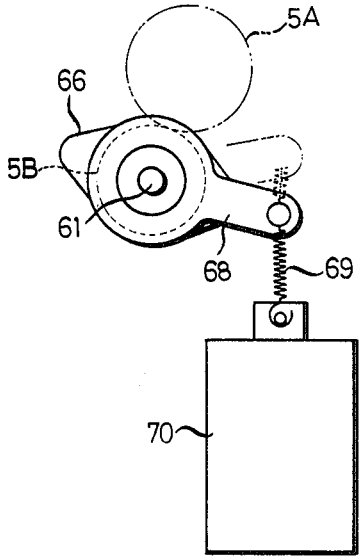
FIG. 18 is a fragmentary view of the means for moving the separation rollers away from each other, in explanation thereof.

Referring to FIG. 17, a shaft 61 supporting the lower separation roller 5B is rotatably supported by left and right side plates 62A and 62B. The shaft 61 is supported at its left end portion through an automatic centering bearing 63 by the left side plate 62A, and the end portion of the shaft 61 disposed outwardly of the bearing 63 mounts thereon a pulley 65 having trained thereover a belt 64 for driving the lower separation roller 5B. The shaft 61 is supported at its right end portion by an eccentric boss 67 attached to an eccentric boss support plate 66 mounted on the right side plate 62B and connected to the solenoid 70 through a pressure applying arm 68 and a spring 69 (See FIG. 18). When the solenoid 70 is not energized, the pressure applying arm 68 is in a dash-and-dot line position shown in FIG. 18. At this time, the shaft 61 is inclined with the automatic centering bearing 63 acting as the center of inclination, thereby producing a gap between the two separation rollers 5A and 5B. At this time, the lower separation roller driving belt 64 and hence the separation rollers 5A and 5B remain stationary. Upon energization of the solenoid 70, the pressure applying arm 68 is pulled by the solenoid 70 into a solid line position shown in FIG. 18, thereby bringing the two separation rollers 5A and 5B into contact with each other.

As aforesaid, when the sheet feeding tray 2 moves upwardly into the sheet feeding position in which the uppermost sheet of the stack of sheets on the tray 2 is brought into contact with the sheet feeding roller 4 as shown in FIG. 7, the control circuit 41 produces instructions to rotate the sheet feeding roller 4 to feed the uppermost sheet on the sheet feeding tray 2, and at the same time the upper separation roller 5A begins to rotate to deliver one sheet after another to the copying station by way of the positioning rollers 58. Detection of each sheet by the sheet sensor 59 automatically stops the rotation of the sheet feeding roller 4 and the upper separation roller 5A, and thereafter the delivery of the sheet is continued by the positioning rollers 58. While the sheet is being delivered, the lower separation roller 5B may either stop its rotation or rotate slowly in a direction opposite to the sheet feeding direction.

If the out-switch button 39 is depressed to move the sheet feeding frame 20 out of the main body to replenish or replace the sheets on the tray 21 then the solenoid 70 is deenergized by way of the control circuit 41, thereby moving the pressure applying arm 68 from its solid line position to its dash-and-dot line position as described previously by referring to FIGS. 17 and 18 and producing a gap between the separation rollers 5A and 5B. Further depression of the out-switch button 39 rotates the drive motor 24 in the reverse direction, thereby moving the sheet feeding tray 2 downwardly. Even if the sheet to be fed in the next sheet feeding operation is already in the position of the separation rollers 5A and 5B or bitten thereby at this time, the sheet is moved intact downwardly together with the sheet feeding tray 2 because there is a gap between the two separation rollers 5A and 5B.

The sheet disposed in the position of the separation rollers 5 may be advantageously returned to its original position by rotating the lower separation roller 5B in the reverse direction or by increasing the speed of its rotation if it is already rotating slowly in the reverse direction.

In the sheet feeding apparatus of the type described hereinabove, it is known to use means for detecting the presence or absence of sheets on the sheet feeding tray, and various types of such means have been proposed. However, the sheet detecting means of the prior art are all of the type which directly detects the presence or absence of the sheets and none of them has been capable of detecting the amount of the residual sheets on the tray 2. For example, when an optical sensor is used, this detecting means will produce a "sheetless" signal upon detecting a dark portion of the sheet, even if a large amount of sheets still remains on the tray 2. This undesirable situation can be avoided as presently to be described.

Figure 19:
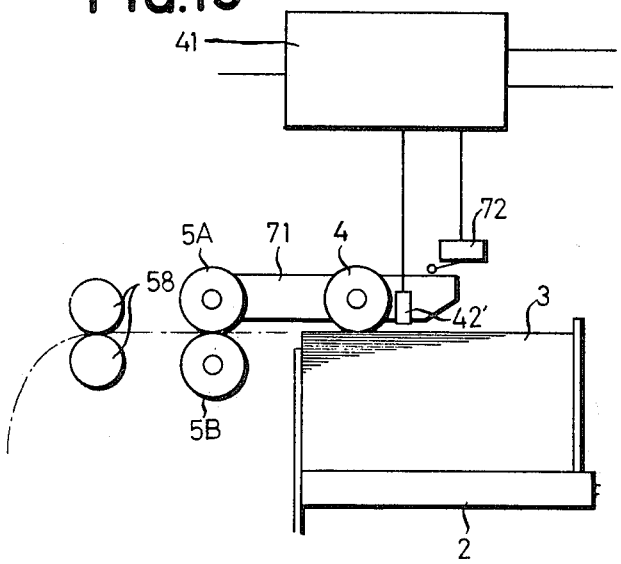
FIG. 19 is a view in explanation of the sheet feeding apparatus provided with means for detecting the presence or absence of sheets and a switch for detecting the height of a stack of copy sheets.

In FIG. 19, the sheet feeding roller 4 and the upper separation roller 5A are rotatably supported by a common support member 71. 42' is an optical sensor for detecting the presence or absence of sheets on the sheet feeding tray 2, and 72 a height detecting switch for keeping the uppermost sheet in a constant position at all times. If all the sheets on the sheet feeding tray 2 are exhausted, then the optical sensor 42' produces a "sheetless" signal because no reflection is obtained due to the presence of a hole in the sheet feeding table 2, for example.

Figure 20:
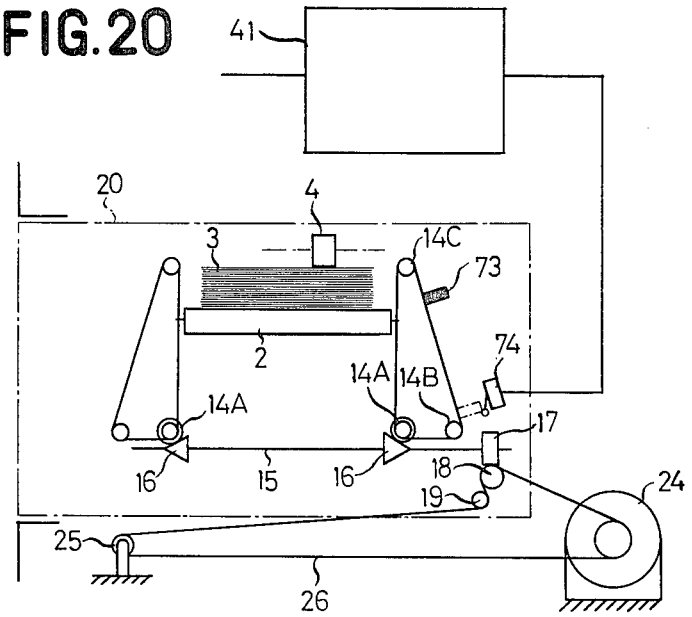
FIG. 20 is a view of the sheet feeding apparatus provided with means for detecting the amount of residual sheets.

In FIG. 20, a detector 73 is attached to an inclined run of one of the endless belts 13, and a detection switch 74 cooperating with the detector 73 is also arranged in spaced apart relation to the inclined run of the endless belt 13.

If the height of the stack of sheets on the sheet feeding tray 2 is reduced as the result of the feeding of the sheets by the sheet feeding roller 4, the detecting switch 72 (See FIG. 19) supplies a signal to the drive motor 24 by way of the control circuit 41 so as to rotate the motor 24 in a direction in which vertical runs of the endless belts 13 move upwardly. This moves the sheet feeding tray 2 upwardly, and when the uppermost sheet of the stack of sheets on the sheet feeding tray 2 is brought into contact with the sheet feeding roller 4 at a normal contact pressure for feeding the sheet, the switch 72 produces a signal for stopping the rotation of the motor 24. The rotation of the endless belts 13 moves downwardly the detector 73 attached to the inclined run of one of the endless belts 13. As the number of the sheets 3 is reduced, the sheet feeding tray 2 moves upwardly and the detector 73 moves downwardly until it actuates the detection switch 74. The detection switch 74 is arranged in a position such that when it is actuated by the detector 73, the number of sheets remaining on the sheet feeding tray 2 is 50~35. The actuation of the detection switch 74 operates, through the control circuit 41, an alarm device or indication device to indicate that the number of the residual sheets on the tray 2 is small or that it is necessary to replenish the sheets on the tray 2. Also, if the sensor 42' for detecting the presence or absence of sheets on the tray 2 is combined with the height detecting switch 72 and a "sheetless" signal produced by the sensor 42' prior to the actuation of the detection switch 74 is considered to indicate the existence of an abnormal condition due to soiling or tearing of the sheets, and if a "sheetless" signal produced by the sensor 42' following the actuation of the detection switch 74 is considered to be a genuine signal, then it is possible to ensure that the sensor 42' performs its detection function with a high degree of precision.

Figure 21:
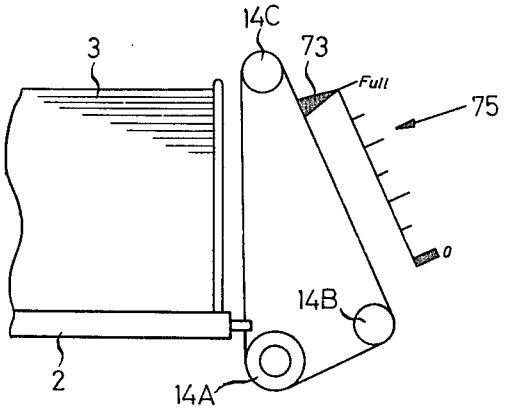
FIG. 21 is a view in explanation of a modification of the means for detecting the amount of residual sheets.

In FIG. 21, an indication device 75 is provided to cooperate with the detector 73 to enable the operator to watch the result of detection from outside. Preferably, the indication device 75 is constructed such that when the detector 73 is indexed with the position of zero in the scale of the indication device 75, the number of the residual sheets on the sheet feeding device 2 is 50~35. It is possible, of course, to combine the indication device 75 with the optical sensor 42' shown in FIG. 19.

In place of the optical sensor 42' shown in FIG. 19, the detecting means of the contact type shown in FIGS.

4 and 5 may be used. The position in which the detector 73 is attached is not limited to the endless belts 13. It may be mounted, with the same result, on a member adapted to move in synchronism with the vertical movement of the sheet feeding table 2, such as the belt 26. The belt may be replaced by a chain or wire within the scope of the invention.

What is claimed is:

1. A sheet feeding apparatus for a copying machine, printing machine, and the like, comprising: a main body, a sheet feeding tray for supporting sheets thereon, mounted in said main body and being capable of moving into and out of said main body, and vertically within said main body; a sheet feeding frame having said sheet feeding tray mounted thereon for vertical movement and capable of moving into and out of said main body of the machine; and a common drive source connected to said sheet feeding frame for movement of said frame into and out of the main body and said sheet feeding tray to move said tray in a vertical direction on said sheet feeding frame and within said main body; a first locking means allowing said sheet feeding tray to move vertically only when said sheet feeding frame is in a sheet feeding position and locking said sheet feeding tray in its lowermost position when said sheet feeding frame is disposed in other positions than the sheet feeding position, and a second locking means for inhibiting the movement of said sheet feeding frame when said sheet feeding tray is not in said lowermost position; a stopper plate including a sheet feeding tray lifting prohibiting portion engagable with an engaged portion of said sheet feeding tray for preventing the upward movement of the sheet feeding tray when the sheet feeding frame is disposed in other positions than the sheet feeding position, and a member of said stopper plate operative to release said sheet feeding tray lifting prohibiting portion of said stopper plate from engagement with said engaged portion of said sheet feeding tray as said member is brought into abutting engagement with a fixed stopper in the main body of the machine when said sheet feeding frame is in the sheet feeding position and also to be locked to the fixed stopper for preventing the movement of said sheet feeding frame out of the main body of the machine when said sheet feeding tray is released from its lowermost position.

2. In a photocopying machine including a housing having means for feeding sheets into association with an image bearing member for the purpose of transferring the image to the sheets, the improvement comprising a frame movable into and out of said housing, a tray for the sheets on said frame, first conveyor means on said frame connected to said tray for moving said tray toward and away from the feeding means for positioning the sheets on said tray into association with said feeding means for the feeding thereof, second conveyor means in the housing connected to said frame for moving said frame out of said housing for the loading and unloading of sheets onto said tray and into said housing, and actuation means connected between said first and second conveyor means and between said tray, said frame and said housing to cause said first conveyor means to move said tray when said frame is inside said housing into association with said feeding means so that the sheets may be fed thereby and to move said tray away from said feeding means, said second conveyor means comprises a motor having a shaft, drive pulley means connected to said shaft, guide pulley means adjacent said shaft, a conveyor element engaged on said guide pulley means and said drive pulley means, said guide pulley means including at least one guide pulley on said frame and being movable with said frame, and said first conveyor means comprising a rotatable drive shaft, and worm means engaged between said rotatable drive shaft and said conveyor element for driving said drive shaft.

3. In a photocopying machine including a housing having means for feeding sheets into association with an image bearing member for the purpose of transferring the image to the sheets, the improvement comprising a frame movable into and out of said housing, a tray for the sheets on said frame, first conveyor means on said frame connected to said tray for moving said tray toward and away from the feeding means for positioning the sheets on said tray into association with said feeding means for the feeding thereof, second conveyor means in the housing connected to said frame for moving said frame out of said housing for the loading and unloading of sheets onto said tray and into said housing, and actuation means connected between said first and second conveyor means and between said tray and frame and said housing to cause said first conveyor means to move said tray when said frame is inside said housing into asociation with said feeding means so that the sheets may be fed thereby and to move said tray away from said feeding means to a lowermost position thereof in said housing, said housing including a stop therein, said frame being movable into said housing until it is stopped by said stop, said actuation means moving said frame into and out of said housing when said tray is in the lowermost position and being effective, when said frame is stopped by said stop, to actuate said first conveyor to move said tray toward said feeding means.

4. In a photocopying machine according to claim 2 wherein said first conveyor means includes at least one other conveyor element connected to said tray and connected to said drive shaft for movement thereby for moving said tray toward and away from said feeding means.

5. A photocopying machine according to claim 3, including a control circuit connected to said sheet feeding means and said second conveyor means for driving said second conveyor means in a selected direction to move said tray selectively into said housing and out of said housing and for initiating the feeding of the sheets.

6. In a photocopying machine according to claim 2 wherein said actuation means includes means engageable with said tray to hold said tray in position during movement of said frame by said second conveyor means.

* * * * *